US011331698B1

(12) United States Patent
DeRosa

(10) Patent No.: US 11,331,698 B1
(45) Date of Patent: May 17, 2022

(54) SELF-CONTAINED WEB CLEANING APPARATUS

(71) Applicant: Richard D. DeRosa, Fairlawn, OH (US)

(72) Inventor: Richard D. DeRosa, Fairlawn, OH (US)

( * ) Notice: Subject to any disclaimer, the term of this patent is extended or adjusted under 35 U.S.C. 154(b) by 477 days.

(21) Appl. No.: 16/216,182

(22) Filed: Dec. 11, 2018

Related U.S. Application Data

(60) Provisional application No. 62/597,481, filed on Dec. 12, 2017.

(51) Int. Cl.

| | |
|---|---|
| ***B08B 13/00*** | (2006.01) |
| ***B08B 5/04*** | (2006.01) |
| ***D21H 25/08*** | (2006.01) |
| ***B08B 1/02*** | (2006.01) |
| ***B08B 1/00*** | (2006.01) |
| ***B41J 15/00*** | (2006.01) |

(52) U.S. Cl.
CPC ..... *B08B 5/046* (2013.01); *B08B 1/002* (2013.01); *B08B 1/02* (2013.01); *B41J 15/00* (2013.01); *D21H 25/08* (2013.01); *B41P 2235/23* (2013.01); *B41P 2235/27* (2013.01); *B65H 2301/5115* (2013.01); *B65H 2301/5133* (2013.01); *B65H 2406/351* (2013.01); *B65H 2406/366* (2013.01)

(58) Field of Classification Search
None
See application file for complete search history.

(56) References Cited

U.S. PATENT DOCUMENTS

| | | | | |
|---|---|---|---|---|
| 2,015,583 | A | 9/1935 | Bartsch | |
| 3,045,273 | A | 7/1962 | Bruno | |
| 3,272,651 | A | 9/1966 | Quirk | |
| 3,395,042 | A | 7/1968 | Herbert, Jr. | |
| 3,453,801 | A * | 7/1969 | Stohlquist | B65B 9/026 53/463 |
| 3,536,528 | A | 10/1970 | DeGeest | |
| 3,986,223 | A | 10/1976 | Kiefer | |
| 4,378,610 | A | 4/1983 | Ermer et al. | |
| 4,454,621 | A | 6/1984 | Testone | |
| 4,835,808 | A | 6/1989 | Hahne et al. | |
| 5,008,968 | A | 4/1991 | Preston | |
| 5,028,959 | A | 7/1991 | Gooray | |
| 5,211,760 | A | 5/1993 | Kedarnath | |
| 5,276,936 | A | 1/1994 | Corrigan | |
| 5,331,503 | A | 7/1994 | McGarry et al. | |
| 5,596,783 | A | 1/1997 | Testone | |

(Continued)

*Primary Examiner* — Eric W Golightly

(57) ABSTRACT

A self-contained web cleaning apparatus is disclosed herein. The self-contained web cleaning apparatus includes a vacuum assembly, the vacuum assembly including a vacuum source, the vacuum source configured to create a vacuum for removing particulate matter from a continuous web of material; and at least one particulate extraction device fluidly coupled to the vacuum assembly, the at least one particulate extraction device defining a slot therein through which the particulate matter from the continuous web of material is extracted. The vacuum assembly and the at least one particulate extraction device are disposed within a self-contained structure without any connections to an external vacuum source located outside of the self-contained web cleaning apparatus.

19 Claims, 5 Drawing Sheets

(56) References Cited

U.S. PATENT DOCUMENTS

| | | | | |
|---|---|---|---|---|
| 5,736,473 | A * | 4/1998 | Cohen | B32B 5/26 442/239 |
| 5,980,646 | A | 11/1999 | DeRosa | |
| 6,962,619 | B1 | 11/2005 | DeRosa et al. | |
| 2004/0216611 | A1* | 11/2004 | Moredock | F02M 35/022 95/271 |
| 2014/0279577 | A1* | 9/2014 | Deering | G06Q 10/30 705/308 |

* cited by examiner

SELF-CONTAINED WEB CLEANING APPARATUS

CROSS-REFERENCE TO RELATED APPLICATIONS

This patent application claims priority to, and incorporates by reference in its entirety, U.S. Provisional Patent Application No. 62/597,481, entitled "Self-Contained Web Cleaning Apparatus", filed on Dec. 12, 2017.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a self-contained web cleaning apparatus. More particularly, the invention relates to a self-contained paper web cleaning apparatus which removes paper dust, chad, and/or static electricity from paper webs either before and/or after the webs are fed into electronic printing equipment.

2. Background

As a result of recent technological developments, breakthroughs have been made in high speed continuous feed printing devices. In particular, high speed continuous feed inkjet printers are now taking over the commercial print industry, and are widely used by Fortune 500 companies for in-house printing. These printers are also widely used by the mail billing industry, the direct mail advertising industry, book publishers, and for on-demand printing, etc. One of the features that increases the speed at which the high speed continuous feed inkjet printers can process paper is by being fed a continuous web or roll of paper rather than individual sheets or fanfold perforated paper.

The major manufacturers and resellers of high speed continuous feed inkjet printers are Ricoh®, Screen GP®, Xerox®, Canon®, Hewlett Packard® (HP), and others. Such high speed continuous feed inkjet printers are extremely expensive, and can cost several hundred thousand dollars or a million dollars making proper maintenance of the printers essential and down or stop time costly.

These high speed continuous feed inkjet printers require a very finely cleaned web in order to achieve maximum throughput. Maximizing productivity is crucial in order to justify the expenditure for the ink jet press. The cleaning of the paper web is also important for maintaining high print quality and maximum life of the print head.

Thus, one of the largest obstacles to keeping high speed continuous feed inkjet printers running correctly is the accumulation of paper dust, chad, and static within the printer. Paper dust and chad gathers upon components within the printer which can cause the printer to jam, stop and function irregularly. These unwanted particles within the printer also cause contamination of the final printed product as well as internal printer mechanisms making it unacceptable to customers, and causing time and money to be wasted. Static electricity built up on the paper web furthers the accumulation of contaminants as it tends to attract paper dust and chad within the environment. In addition, static electric charges cause damage to the electronic components within the high speed continuous feed inkjet printers resulting in significant periods of down time and costly repairs.

Conventional printer cleaning solutions have numerous limitations and drawbacks. For example, attempting to prevent damage to high speed continuous feed inkjet printers by periodically stopping the printing process and cleaning the paper dust and chad from the printer using a vacuum or other miscellaneous tools is highly undesirable. Significant costs are attributed to this type of maintenance because there is down time in which no printed product can be produced while the cleaning is being done and additional manpower must be expended as the cleaning must be done manually. Also, consumables, such as ink, must also be replaced more often as they to become contaminated by the paper dust.

An additional problem caused by the paper dust and chad is that, because the paper webs are being processed at high speeds, some of the dust is discharged into the surrounding work environment and poses significant health problems for workers in and around the electronic continuous web printers.

Therefore, what is needed is a web cleaning apparatus that is configured as a self-contained, standalone unit for cleaning and treating paper webs prior to the paper web being fed into a piece of electronic printing equipment (e.g., a high speed continuous feed inkjet printer). Moreover, a self-contained web cleaning apparatus is needed that removes, paper dust, chad, static and other contaminates from a web of paper after it leaves the roll paper unwinder before it is fed into the electronic printing equipment. Furthermore, there is a need for a web cleaning apparatus that reduces paper dust, chad, and other contaminants from the work environment surrounding the electronic printing equipment, thereby providing a safer and healthier environment for employees working around the printing equipment.

BRIEF SUMMARY OF EMBODIMENTS OF THE INVENTION

Accordingly, the present invention is directed to a self-contained web cleaning apparatus that substantially obviates one or more problems resulting from the limitations and deficiencies of the related art.

In accordance with one or more embodiments of the present invention, there is provided a self-contained web cleaning apparatus that includes a vacuum assembly, the vacuum assembly including a vacuum source, the vacuum source configured to create a vacuum for removing particulate matter from a continuous web of material; and at least one particulate extraction device fluidly coupled to the vacuum assembly, the at least one particulate extraction device defining a slot therein through which the particulate matter from the continuous web of material is extracted. In these one or more embodiments, the vacuum assembly and the at least one particulate extraction device are disposed within a self-contained structure without any connections to an external vacuum source located outside of the self-contained web cleaning apparatus.

In a further embodiment of the present invention, the vacuum source is in the form of a blower configured to draw air containing the particulate matter from the continuous web of material through the slot of the at least one particulate extraction device.

In yet a further embodiment, the blower is a centrifugal-type blower.

In still a further embodiment, the vacuum assembly further comprises a cyclone separator, a filter, and a debris collection tray, the cyclone separator being fluidly coupled to the vacuum source, the cyclone separator configured to separate the particulate matter by centrifugal force such that particulates smaller than or equal to a predetermined size are configured to be accumulated in the filter and particulates larger than a predetermined size are configured to be collected in the debris collection tray.

In yet a further embodiment, the debris collection tray comprises a cleanout port configured to allow the particulates to be cleaned from the debris collection tray.

In still a further embodiment, the debris collection tray comprises a sensor unit configured to detect whether the debris collection tray is full of particulates so that a user is able to be alerted when the debris collection tray needs to be emptied.

In yet a further embodiment, the at least one particulate extraction device comprises a first manifold with the slot defined thereby, the first manifold being fluidly coupled to the vacuum source by means of a first exhaust pipe.

In still a further embodiment, the self-contained web cleaning apparatus further comprises a second manifold being fluidly coupled to the vacuum source by means of a second exhaust pipe, the second manifold defining an additional slot therein through which the particulate matter from the continuous web of material is extracted, the second manifold configured to be disposed on a side of the continuous web of material which is opposite to a side on which the first manifold is disposed.

In yet a further embodiment, the self-contained web cleaning apparatus further comprises at least one roller configured to guide the continuous web of material as the continuous web of material passes through the self-contained web cleaning apparatus.

In still a further embodiment, the at least one roller comprises an input roller on a first side of the self-contained web cleaning apparatus where the continuous web of material enters the self-contained web cleaning apparatus, and an output roller on a second side of the self-contained web cleaning apparatus where the continuous web of material exits the self-contained web cleaning apparatus.

In yet a further embodiment, the self-contained web cleaning apparatus further comprises at least one brush configured to contact the continuous web of material as the continuous web of material passes through the self-contained web cleaning apparatus, the at least one brush configured to loosen and remove the particulate matter from the continuous web of material.

In still a further embodiment, the at least one brush comprises two or more brushes for loosening and removing the particulate matter from the continuous web of material, wherein the combination of the two or more brushes is configured to contact and treat both sides of the continuous web of material as the continuous web of material passes through the self-contained web cleaning apparatus.

In yet a further embodiment, the self-contained web cleaning apparatus further comprises a static charge eliminator configured to neutralize static electric charges built up on the continuous web of material.

In still a further embodiment, the static charge eliminator is located proximate to an input side of the self-contained web cleaning apparatus where the continuous web of material enters the self-contained web cleaning apparatus.

In yet a further embodiment, the self-contained web cleaning apparatus further comprises a temperature sensor configured to detect a temperature of the space in which the self-contained web cleaning apparatus is located, and to output a first signal indicative of the temperature; a humidity sensor configured to detect a humidity of the space in which the self-contained web cleaning apparatus is located, and to output a second signal indicative of the humidity; a visual display device disposed on a side of the self-contained web cleaning apparatus; and a control device operatively coupled to the temperature sensor, the humidity sensor, and the visual display device, the control device configured to process the first and second signals from the temperature and humidity sensors to output the temperature and humidity information to the visual display device so that temperature and humidity information is visible to a user.

In still a further embodiment, the visual display device is in the form of a touchscreen user interface.

In yet a further embodiment, the control device comprises a microprocessor.

In still a further embodiment, the self-contained web cleaning apparatus further comprises a throughput sensor operatively coupled to the control device, the throughput sensor configured to track the continuous web of material as the continuous web of material passes through the self-contained web cleaning apparatus, and the control device configured to determine a throughput count footage for the continuous web of material based upon the output from the throughput sensor and to display the throughput count footage on the visual display device.

In yet a further embodiment, the continuous web of material is in the form of a continuous web of paper being fed into a high speed continuous feed inkjet printer.

In still a further embodiment, the continuous web of paper is configured to pass through the self-contained web cleaning apparatus prior to the continuous web of paper entering the high speed continuous feed inkjet printer so that the particulate matter is removed from the continuous web of paper prior to the continuous web of paper entering the high speed continuous feed inkjet printer.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
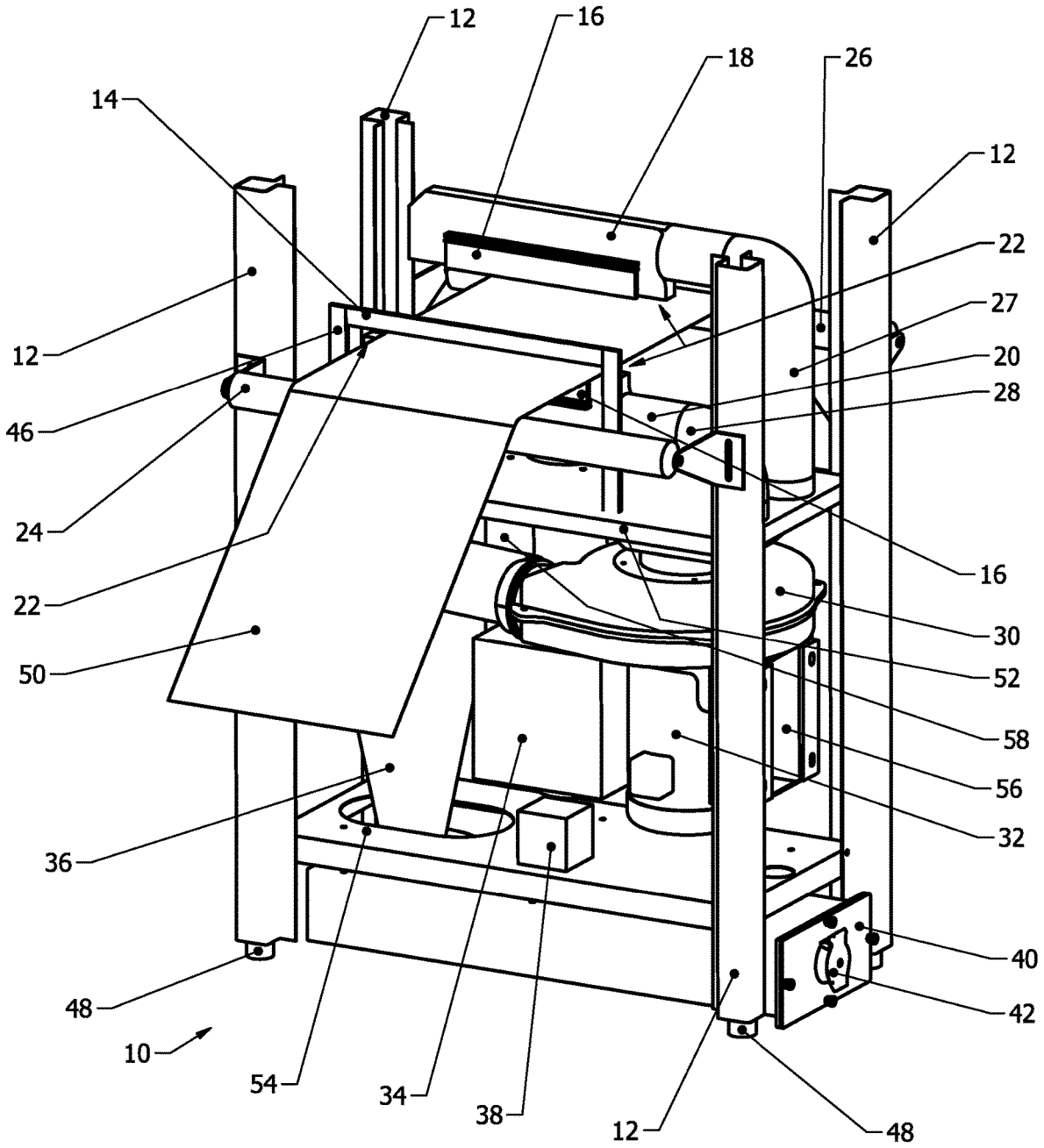
FIG. 1 is a perspective view of a self-contained web cleaning apparatus shown processing a continuous paper web, according to an embodiment of the invention.

An illustrative embodiment of the self-contained web cleaning apparatus is seen generally at 10 in FIGS. 1-4. As shown in these figures, the self-contained web cleaning apparatus 10 generally comprises a vacuum assembly 30, 34, 36, 40, the vacuum assembly 30, 34, 36, 40 including a vacuum source 30, the vacuum source 30 configured to create a vacuum for removing particulate matter from a continuous web of material (e.g., paper web 50); and at least one particulate extraction device 18, 20 fluidly coupled to the vacuum assembly 30, 34, 36, 40, the at least one particulate extraction device 18, 20 defining a slot 22 (or one or more apertures) therein through which the particulate matter from the continuous web of material 50 is extracted. The vacuum assembly 30, 34, 36, 40 and the at least one particulate extraction device 18, 20 are disposed within a self-contained structure (with vertical frame members 12 and shelves 52, 54) without any connections to an external vacuum source located outside of the self-contained web cleaning apparatus 10. Advantageously, the self-contained web cleaning apparatus 10 described herein does not require any type of external vacuum source because all of the necessary vacuum assembly components are disposed within its self-contained structure. In one or more embodiments, the continuous web of material is in the form of a continuous web of paper 50 being fed into a high speed continuous feed inkjet printer. Also, in one or more embodiments, the continuous web of paper 50 is configured to pass through the self-contained web cleaning apparatus 10 prior to the continuous web of paper 50 entering the high speed continuous feed inkjet printer so that the particulate matter is removed from the continuous web of paper 50 prior to the continuous web of paper 50 entering the high speed continuous feed inkjet printer.

In the illustrative embodiment, the self-contained web cleaning apparatus 10 is used as a standalone unit to remove paper dust, chad, and static electrical charges from a continuously fed web of paper 50. As will be described in detail hereinafter, apparatus 10 comprises a housing to enclose the internal components of the apparatus 10, and to elevate the manifold compartment of the apparatus 10 to an acceptable height for cleaning the continuous paper web 50. As a completely standalone unit, the self-contained web cleaning apparatus 10 is not attached to the high speed continuous feed inkjet printer or to any paper unwinder in the feed unit of the printer. The apparatus 10 is configured to be placed squared-up to, and in line with the printer (i.e., in front of the paper inlet slot of the printer) so that once the paper web 50 is fed through the apparatus 10, it is operational. The apparatus 10 does not contain any electrical connections to the paper unwinder or to the printer, but rather depends on the operation of the printer and paper unwinder for advancing the paper web 50 through the apparatus 10.

Initially, with combined reference to FIGS. 1-3, the particulate extraction devices 18, 20 of the self-contained web cleaning apparatus 10 will be explained. As shown in these figures, in the illustrative embodiment, the particulate extraction devices 18, 20 are in the form of a first manifold 18 (i.e., upper manifold 18) and a second manifold 20 (i.e., lower manifold 20). The two manifolds 18, 20 are mounted in operable cooperation with one another at the top of the self-contained web cleaning apparatus 10. Each manifold 18, 20 is elongated and includes an elongated slot 22 into which paper dust, chad, and other contaminants are drawn when air is drawn through the manifold 18, 20 by the internal vacuum source 30. The two manifolds 18, 20 are physically arranged such that their elongated slots 22 are facing one another so that each manifold 18, 20 treats one side of the continuous paper web 50 as it is fed through and between the two manifolds 18, 20 (i.e., the manifold 18, 20 are disposed on opposite sides of the continuous paper web 50). In particular, as best shown in the perspective view of FIG. 1, the upper manifold 18 is located above the continuous paper web 50, while the lower manifold 20 is located beneath the continuous paper web 50. In one or more embodiments, each of the manifolds 18, 20 may include a serrated face plate (e.g., formed from stainless steel or another suitable material) to make surface contact with the paper web 50 to loosen dust and debris.

Referring again to FIGS. 1 and 3, it can be seen that each manifold 18, 20 includes an exhaust pipe 27, 28 extending from one side thereof to provide an interface between the manifold 18, 20 and the internal vacuum source 30. The internal vacuum source 30 of the self-contained web cleaning apparatus 10 provides manifolds 18, 20 with the vacuum force needed to remove paper dust and chad from the paper web 50 as it passes through apparatus 10. As shown in FIGS. 1 and 2, the upper manifold 18 is fluidly coupled to the vacuum source 30 by means of a first exhaust pipe 27, while the lower manifold 20 is fluidly coupled to the vacuum source 30 by means of a second exhaust pipe 28. In the end view of FIG. 2, it can be seen that the exhaust pipes 27, 28 both terminate into a manifold coupling/blower intake fitting 29 that connects the exhaust pipes 27, 28 to the inlet of the vacuum source 30 (i.e., blower 30). While not shown in the drawings, each of the exhaust pipes 27, 28 may contain a regulator or damper disposed therein to maintain the correct amount or volume of vacuum draw at each of the manifolds 18, 20.

Now, referring primarily to FIGS. 1 and 3, the vacuum assembly 30, 34, 36, 40 of the self-contained web cleaning apparatus 10 will be described. In the illustrative embodiment, as best shown in FIG. 1, it can be seen that the vacuum source is in the form of a blower 30 configured to draw air containing the particulate matter from the continuous web of material 50 through the slots 22 of the upper and lower manifolds 18, 20. More particularly, in the illustrative embodiment, the blower 30 is a centrifugal-type blower. In FIGS. 1 and 3, it can be seen that the blower 30 is powered by a blower motor 32. In the illustrative embodiment, the blower 30 and its associated motor 32 are connected to the side of the apparatus 10 by the bracket 56. The bracket 56 supports the blower 30 and its associated motor 32 in a cantilevered manner from the side of the apparatus 10 (i.e., from the frame and/or housing of the apparatus 10).

Referring again to FIGS. 1 and 3, it can be seen that, in the illustrative embodiment, the vacuum assembly 30, 34, 36, 40 further comprises a cyclone separator 36, a filter box 34, and a debris collection tray 40. The inlet of the cyclone separator 36 is fluidly coupled to the discharge end of the vacuum source 30 (i.e., blower 30). The cyclone separator 36 separates the particulate matter extracted from the continuous paper web 50 by centrifugal force such that particulates smaller than or equal to a predetermined size (e.g., smaller than or equal to 3 microns) are accumulated in the internal filter of the filter box 34, and particulates larger than a predetermined size (e.g., larger than 3 microns) are collected in the debris collection tray 40. As shown in FIGS. 1 and 3, the debris collection tray 40 is connected to the bottom outlet end of the cyclone separator 36. The filter box 34 is connected to the top of the cyclone separator 36 by the connection pipe or hose 58 (see FIG. 3). The particulates smaller than or equal to the predetermined size (e.g., 3 microns) travel from the top of the cyclone separator 36 to the filter box 34 via the connection pipe or hose 58. After the airstream from the discharge side of the blower 30 is filtered by the internal filter of the filter box 34, the air is discharged into the room in which the self-contained web cleaning apparatus 10 is disposed. As such, particulate-laden intake air is drawn into the apparatus 10 via the elongated slots 22 of the manifolds 18, 20, large particulates are removed from the air by the cyclone separator 36, small particulates are removed by the internal filter of the filter box 34, and then once the air has been cleaned and filtered, it is discharged from the side of the enclosure of the apparatus 10 after it has passed through the filter of the filter box 34.

Figure 3:
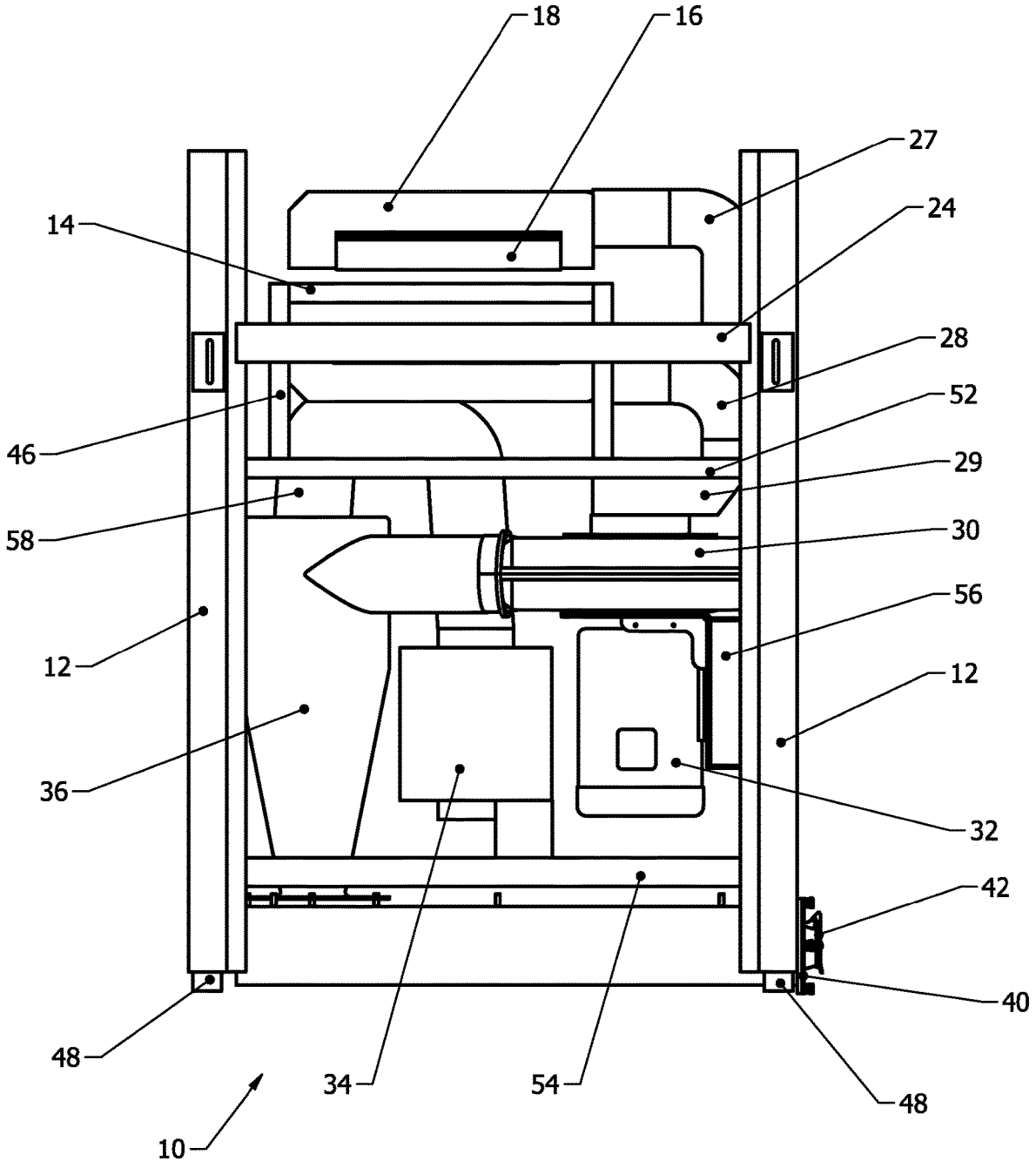
FIG. 3 is a front side view of the self-contained web cleaning apparatus shown in FIG. 1.

As shown in the perspective view of FIG. 1, and in the end view of FIG. 3, the debris collection tray 40 comprises a cleanout port 42 allowing the particulates to be cleaned from the debris collection tray 40 using a vacuum cleaner (e.g., by using a typical shop vacuum cleaner) so that it is not necessary to slide out and remove the entire tray 40 when the tray 40 is full of particulates. More particularly, in the illustrative embodiment, the cleanout port 42 may comprise a spring-loaded door that is capable of being easily accessed by the user of the self-contained web cleaning apparatus 10 when the debris collection tray 40 needs cleaned out. Also, advantageously, the spring-loaded door of the cleanout port 42 allows the debris collection tray 40 to be cleaned out by the user without stopping the apparatus 10 so that the printing process is not disrupted during the cleaning of debris collection tray 40. In one or more embodiments, the user may periodically clean out the debris collection tray 40 so that it does not become full of particulates (e.g., once every week or once every two weeks depending on the footage of paper 50 printed).

In one or more embodiments, the debris collection tray 40 may further include a sensor unit 68 (e.g., an ultrasonic or infrared sensor unit—see FIG. 5) configured to detect when the debris collection tray 40 is full of particulates so that the user is able to be alerted when the debris collection tray 40 needs to be emptied. In these one or more embodiments, the sensor unit 68 may measure the level of particulates at the top of the debris collection tray 40 in order to determine when the tray 40 is full. As will be described in further detail hereinafter, the sensor unit 68 of the debris collection tray 40 may be part of a sensing and control system provided in the self-contained web cleaning apparatus 10. The sensing and control system may include a visual display device 72 (e.g., a liquid crystal display (LCD) screen, or the like) for displaying a message to the user when the sensor unit detects that the debris collection tray 40 is full (see FIG. 5).

With reference to FIGS. 1-4, it can be seen that the illustrative self-contained web cleaning apparatus 10 further comprises a support structure for supporting the internal components of the apparatus 10. Initially, as shown in the illustrative embodiment of FIG. 1, it can be seen that the support structure of the apparatus 10 comprises four (4) vertical frame members 12. Each of the frame members is disposed in a respective one of the four (4) corners of the apparatus housing. Turning again to FIG. 1, it can be seen that vertical frame members 12 are connected to one another by means of an upper shelf member 52 and a lower shelf member 54. The upper shelf member 52 is disposed below the manifolds 18, 20 and separates the manifold compartment of the apparatus 10 from the vacuum assembly compartment of the apparatus 10. The vacuum assembly compartment of the apparatus 10, which is defined between the upper and lower shelf members 52, 54 houses the blower 30, blower motor 32, filter box 34, and cyclone separator 36 of the vacuum assembly 30, 34, 36, 40. In FIG. 1, it can be seen that the debris collection tray 40 is disposed beneath the lower shelf member 54 (i.e., in the space between the floor on which the apparatus 10 is disposed and the bottom of the lower shelf member 54). Also, as shown in FIG. 1, support feet 48 are connected to the bottom end of each vertical frame member 12 so as to support the apparatus 10 on a floor surface. In the illustrative embodiment, one or more of the support feet 48 may be in the form of an adjustable leveling foot for leveling the apparatus 10 on an uneven floor surface. That is, each adjustable leveling foot may be extended or retracted from the bottom of its vertical frame member 12 so as to maintain apparatus 10 in a level position even when placed upon a floor surface that is not level.

While the self-contained web cleaning apparatus 10 is illustrated with its side access panels removed in FIGS. 1-4 in order to reveal the internal components of the apparatus 10, it is to be understood that, in the illustrative embodiment, the apparatus 10 is provided with access panels on each side thereof so that internal components of the apparatus 10 are completely enclosed within a peripheral housing, thereby protecting the internal components from damage, dust, and other debris. Each of these access panels may be easily removable from the frame members 12 of the apparatus 10 so that the internal components of the apparatus 10 may be serviced when needed. Also, slots may be provided on opposite sides of the housing for accommodating the paper web 50 entering and exiting the apparatus 10.

Figure 4:
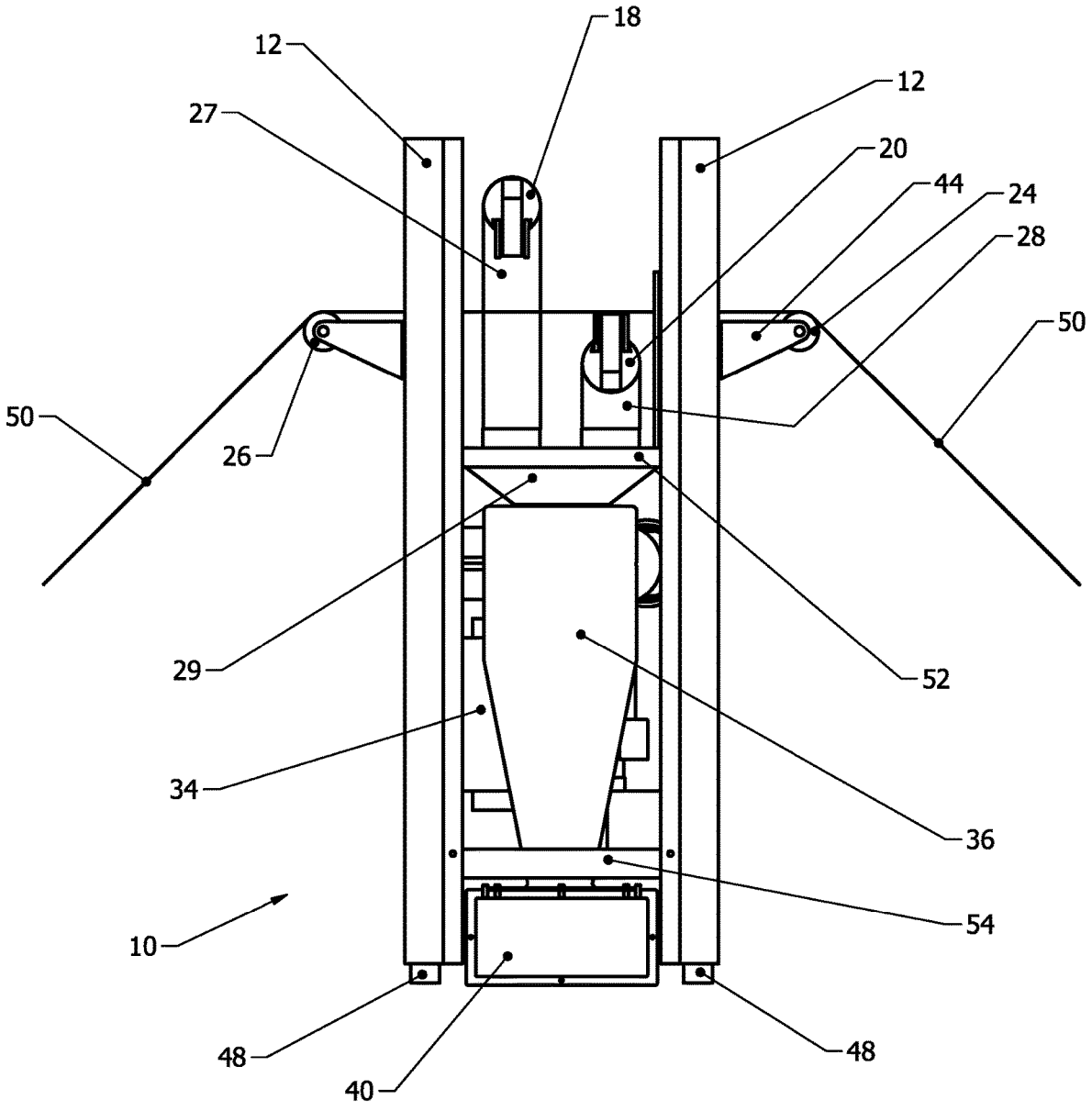
FIG. 4 is a second end view of the self-contained web cleaning apparatus shown in FIG. 1.

Next, referring primarily to FIGS. 1, 2, and 4, the static charge eliminator 14, the brushes 16, and the input and output rollers 24, 26 of the illustrative self-contained web cleaning apparatus 10 will be described. Initially, as best shown in FIGS. 1 and 2, the apparatus 10 further comprises a static charge eliminator 14 that is configured to neutralize static electric charges built up on the continuous web of material (i.e., on the paper web 50). As shown in the illustrative embodiment, the elongate static charge eliminator 14 is located proximate to an input side of the self-contained web cleaning apparatus 10 where the continuous web of paper 50 enters the self-contained web cleaning apparatus 10. In the illustrative embodiment, the power supply 38 for the static charge eliminator 14 is located on the lower shelf member 54, and in the vacuum assembly compartment of the apparatus 10 (refer to FIG. 1). The static charge eliminator 14 is shockless to provide safety to users, and it consists of an elongated bar which neutralizes static electrical charges built up upon the continuous paper web 50 through either a passive or active AC elimination system. As shown in FIG. 2, the static charge eliminator 14 is disposed proximate to the lower manifold 20 so that as the continuous paper web 50 is passed between manifolds 18, 20, it will also pass over the static charge eliminator 14 to neutralize any static electrical charges built up on either side of the continuous paper web 50. By eliminating static charges from the continuous paper web 50 before it passes through manifolds 18, 20 and the brushes 16 described hereinafter, the additional attractive force on the paper dust and chad is neutralized making the contaminants easier to remove (i.e., the static charge eliminator 14 breaks the surface adhesion of the paper dust and debris on the top and bottom of the paper). As such, the static charge eliminator 14 advantageously further improves web throughput. Referring again to FIGS. 1 and 2, it can be seen that, in the illustrative embodiment, the static charge eliminator 14 is supported from the upper shelf member 52 by the static eliminator bracket 46, which elevates the static charge eliminator 14 above the top surface of the paper web 50.

Turning again to FIGS. 1, 2, and 4, it can be seen that, in the illustrative embodiment, the self-contained web cleaning apparatus 10 further comprises a pair of rollers 24, 26 for guiding the continuous web of paper 50 as the continuous web of paper 50 passes through the self-contained web cleaning apparatus 10. In particular, as shown in these figures, the self-contained web cleaning apparatus 10 includes an input roller 24 on a first side of the apparatus 10 where the continuous web of paper 50 enters the self-contained web cleaning apparatus (i.e., on the input side of the apparatus 10). The self-contained web cleaning apparatus 10 further includes an output roller 26 on a second side of the apparatus 10 where the continuous web of paper 50 exits the apparatus 10 (i.e., on the output side of the apparatus 10). Advantageously, the input and output rollers 24, 26 help to maintain proper alignment of the continuous paper web 50 as it is processed by cleaning apparatus 10. As best shown in the end views of FIGS. 2 and 4, the input and output rollers 24, 26 are coupled to the vertical frame members 12 of the apparatus 10 by a plurality of roller mounting brackets 44. In the illustrative embodiment, a mounting bracket 44 is provided at each of the oppositely disposed longitudinal ends of the rollers 24, 26. As shown in the figures, both input and output rollers 24, 26 are elongated and are mounted in parallel with elongated manifolds 18, 20. Both rollers 24, 26 are mounted near the top of the apparatus support structure and at the same height in order to maintain the continuous web of paper 50 in a planar position as it is being passed between and through manifolds 18, 20. By maintaining the continuous paper web 50 in an optimum position, manifolds 18, 20 and the brushes 16, which will be described hereinafter, are most effective and the overall throughput of the continuous paper web 50 is maximized.

Figure 2:
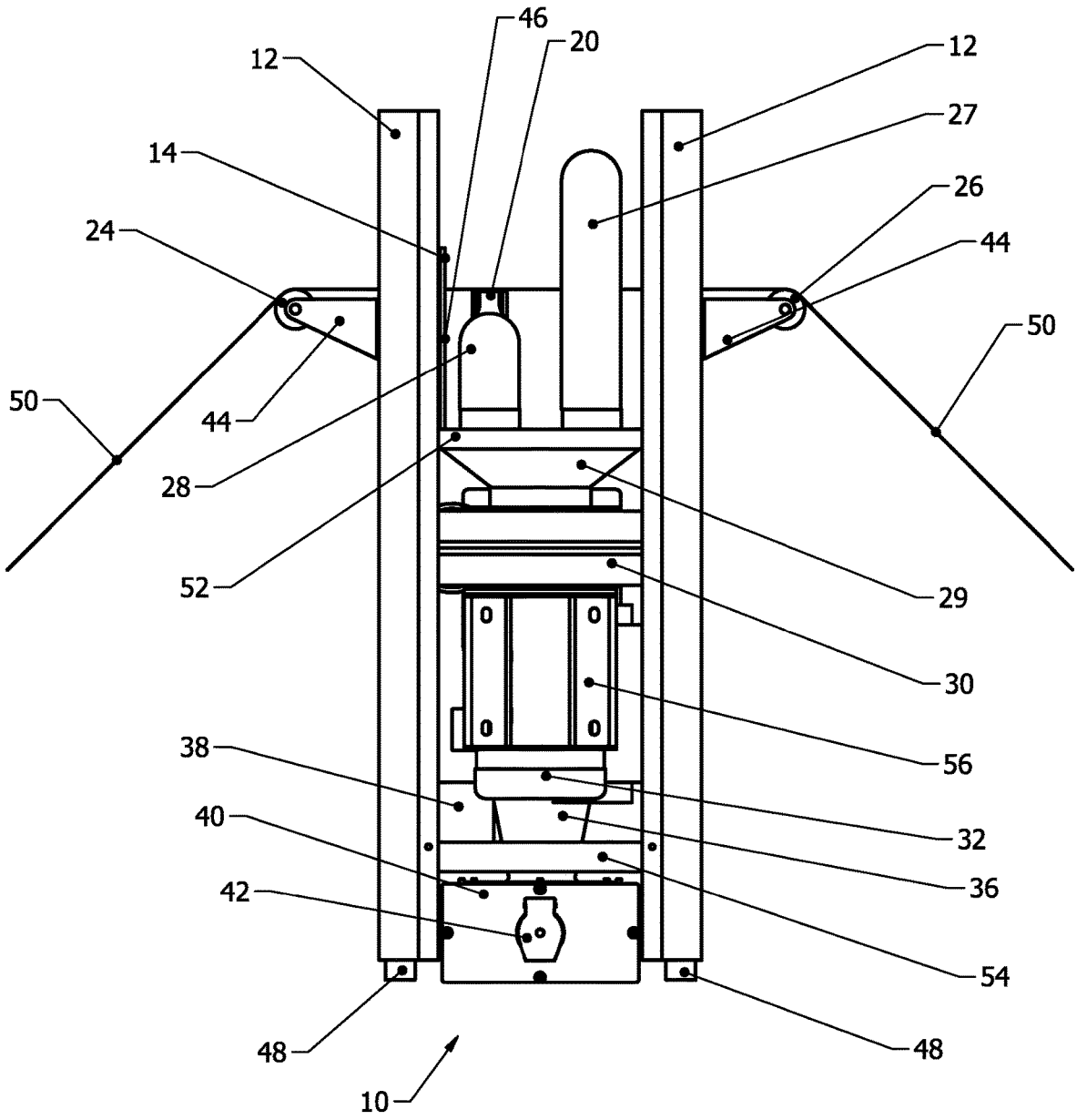
FIG. 2 is a first end view of the self-contained web cleaning apparatus shown in FIG. 1.

In the illustrative embodiment, as shown in FIGS. 1 and 2, the self-contained web cleaning apparatus 10 additionally comprises a plurality of brushes 16 configured to contact the continuous web of paper 50 as the continuous web of paper 50 passes through the self-contained web cleaning apparatus 10. The brushes 16 are configured to loosen and remove the particulate matter from the continuous web paper 50. The combination of brushes 16 are configured to contact and treat both sides of the continuous web of paper 50 as the continuous web of paper 50 passes through the self-contained web cleaning apparatus 10. Referring again to the illustrative embodiment of FIGS. 1 and 2, it can be seen that each manifold 18, 20 includes two elongated rows of brushes 16, one located on either side of elongated slot 22 of the manifold 18, 20. Advantageously, the brushes 16 remove and loosen paper dust, chad, and other contaminants from the continuous paper web 50 which is collected by manifolds 18, 20 through elongated slots 22. The two manifolds 18, 20 are physically arranged such that their brushes 16 and elongated slots 22 are facing one another so that each manifold 18, 20 treats one side of the continuous paper web 50 as it is fed through and between the two manifolds 18, 20.

Figure 5:
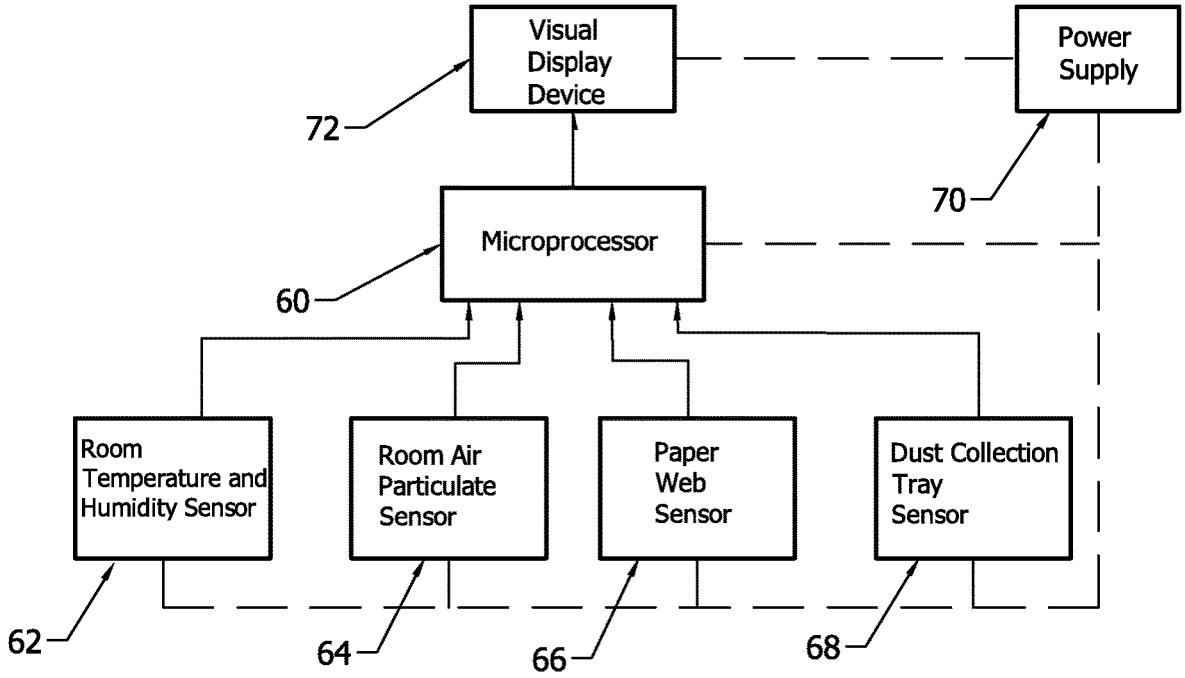
FIG. 5 is a block diagram illustrating a sensing and control system that may be provided in the self-contained web cleaning apparatus shown in FIG. 1.

In one or more embodiments, with reference to the block diagram of FIG. 5, the self-contained web cleaning apparatus 10 may further include a sensing and control system to perform various monitoring functions. As shown in FIG. 5, the sensing and control system of the self-contained web cleaning apparatus 10 may include a room temperature and humidity sensor 62 to detect the temperature and humidity of the space in which the self-contained web cleaning apparatus 10 is located. The sensing and control system of the self-contained web cleaning apparatus 10 may further include room air particulate sensor 64 to detect the amount of particulates in the air of the space in which the self-contained web cleaning apparatus 10 is located. The room temperature and humidity sensor 62 and the room air particulate sensor 64 output signals indicative of the temperature, humidity, and air particulate level of the space. Referring again to FIG. 5, it can be seen that the room temperature and humidity sensor 62 and the room air particulate sensor 64 are operatively coupled to a control device or processor (e.g., comprised of a microprocessor 60) that processes the signals from the room temperature and humidity sensor 62 and the room air particulate sensor 64 so that the temperature and humidity information and air particulate information may be displayed to the user on a visual display device 72. The visual display device 72, which may be in the form of a touchscreen user interface, is disposed on a side of the self-contained web cleaning apparatus 10 (e.g., on the operator side of the apparatus 10). In addition to comprising a microprocessor, the control device 60 may also include relays, digital logic circuits, etc. for processing the data from sensors 62, 64.

Turning again to the block diagram of FIG. 5, it can be seen that the sensing and control system of the self-contained web cleaning apparatus 10 may further include a paper web sensor 66 (i.e., a paper web throughput sensor) that tracks the continuous web of paper 50 as the continuous web of paper 50 passes through the self-contained web cleaning apparatus 10. Like the room temperature and humidity sensor 62 and the room air particulate sensor 64 described above, the paper web throughput sensor 66 is also operatively coupled to the control device (i.e., microprocessor 60). The control device 60 determines the throughput count footage for the continuous web of paper 50 based upon the output from the paper web throughput sensor 66, and displays the throughput count footage to the user on the visual display device 72.

As described above in conjunction with the debris collection tray 40 of the apparatus 10, the sensing and control system may additionally include a dust collection tray sensor 68 configured to detect when the debris collection tray 40 is full of particulates so that the user is able to be alerted when the debris collection tray 40 needs to be emptied. Like the aforedescribed sensors 62, 64, 66, the dust collection tray sensor 68 is also operatively coupled to the control device (i.e., microprocessor 60). The control device 60 determines whether or not the debris collection tray 40 is full of particulates based upon the output from the dust collection tray sensor 68, and displays the appropriate notification to the user on the visual display device 72.

In addition, as shown in FIG. 5, the sensing and control system of the self-contained web cleaning apparatus 10 may further include a power supply module 70 that provides power to the control device 60, the sensors 62, 64, 66, 68, and the visual display device 72. In one or more embodiments, the power supply module 70 may separately power each of the components 60, 62, 64, 66, 68, 72 of the sensing and control system. In one or more alternative embodiments, the power supply module 70 may power only the control device 60 and the visual display device 72, and then the control device 60 may provide power to each of the individual sensors 62, 64, 66, 68. In one or more embodiments, the power supply module 70 may be in the form of a power strip for providing power to each of the components 60, 62, 64, 66, 68, 72 of the sensing and control system.

In one or more embodiments, the sensors 62, 64, 66, 68 and visual display device 72 may be operatively coupled to the control device 60 by wired connections. In one or more alternative embodiments, the sensors 62, 64, 66, 68 and visual display device 72 may be operatively coupled to the control device 60 by wireless connections (e.g., by using radio-frequency (RF) communication).

It is readily apparent that the aforedescribed self-contained web cleaning apparatus 10 offers numerous advantages. First, the web cleaning apparatus 10 is configured as a self-contained, standalone unit for cleaning and treating paper webs prior to the paper web being fed into a piece of electronic printing equipment (e.g., a high speed continuous feed inkjet printer) so that no connections are required to an external vacuum source. With the advent of the high speed continuous feed inkjet printer, which results in a significant reduction in the total number of printers being used at the same site (e.g., a 5 to 1 reduction for replacing electronic variable data toner printers with high speed continuous feed inkjet printers), there is no need for a central paper debris collection system. Advantageously, the aforedescribed web cleaning apparatus 10 is capable of being universally used with all high speed continuous feed inkjet printers, and thus fills an important need for a plug-and-play device for the high speed continuous feed inkjet printer market. Secondly, the aforedescribed self-contained web cleaning apparatus 10 removes, paper dust, chad, static and other contaminates from a web of paper after it leaves the roll paper unwinder before it is fed into the electronic printing equipment, thereby maintaining high print quality and maximizing the life of the print head. The robust self-contained web cleaning apparatus 10 described above is capable of being used in high speed printing installations with a 3,000 feet per minute web press speed. Finally, the self-contained web cleaning apparatus 10 described herein reduces paper dust, chad, and other contaminants from the work environment surrounding the electronic printing equipment, thereby providing a safer and healthier environment for employees working around the printing equipment.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A self-contained web cleaning apparatus, comprising:

a self-contained structure;

a vacuum assembly, the vacuum assembly including a vacuum source, the vacuum source configured to create a vacuum for removing particulate matter from a continuous web of material; and at least one particulate extraction device fluidly coupled to the vacuum assembly, the at least one particulate extraction device defining a slot therein through which the particulate matter from the continuous web of material is extracted, the at least one particulate extraction device comprising a first manifold with the slot defined thereby, the first manifold being fluidly coupled to the vacuum source by means of a first exhaust pipe;

wherein the vacuum assembly and the at least one particulate extraction device are disposed within the self-contained structure without any connections to an external vacuum source located outside of the self-contained web cleaning apparatus.

2. The self-contained web cleaning apparatus according to claim 1, wherein the vacuum source is in the form of a blower configured to draw air containing the particulate matter from the continuous web of material through the slot of the at least one particulate extraction device.

3. The self-contained web cleaning apparatus according to claim 2, wherein the blower is a centrifugal-type blower.

4. The self-contained web cleaning apparatus according to claim 1, wherein the vacuum assembly further comprises a cyclone separator, a filter, and a debris collection tray, the cyclone separator being fluidly coupled to the vacuum source, the cyclone separator configured to separate the particulate matter by centrifugal force such that particulates smaller than or equal to a predetermined size are configured to be accumulated in the filter and particulates larger than a predetermined size are configured to be collected in the debris collection tray.

5. The self-contained web cleaning apparatus according to claim 4, wherein the debris collection tray comprises a cleanout port configured to allow the particulates to be cleaned from the debris collection tray.

6. The self-contained web cleaning apparatus according to claim 4, wherein the debris collection tray comprises a sensor unit configured to detect whether the debris collection tray is full of particulates so that a user is able to be alerted when the debris collection tray needs to be emptied.

7. The self-contained web cleaning apparatus according to claim 1, further comprising a second manifold being fluidly coupled to the vacuum source by means of a second exhaust pipe, the second manifold defining an additional slot therein through which the particulate matter from the continuous web of material is extracted, the second manifold configured to be disposed on a side of the continuous web of material which is opposite to a side on which the first manifold is disposed.

8. The self-contained web cleaning apparatus according to claim 1, further comprising at least one roller configured to guide the continuous web of material as the continuous web of material passes through the self-contained web cleaning apparatus.

9. The self-contained web cleaning apparatus according to claim 8, wherein the at least one roller comprises an input roller on a first side of the self-contained web cleaning apparatus where the continuous web of material enters the self-contained web cleaning apparatus, and an output roller on a second side of the self-contained web cleaning apparatus where the continuous web of material exits the self-contained web cleaning apparatus.

10. The self-contained web cleaning apparatus according to claim 1, further comprising at least one brush configured to contact the continuous web of material as the continuous web of material passes through the self-contained web cleaning apparatus, the at least one brush configured to loosen and remove the particulate matter from the continuous web of material.

11. The self-contained web cleaning apparatus according to claim 10, wherein the at least one brush comprises two or more brushes for loosening and removing the particulate matter from the continuous web of material, wherein the combination of the two or more brushes is configured to contact and treat both sides of the continuous web of material as the continuous web of material passes through the self-contained web cleaning apparatus.

12. The self-contained web cleaning apparatus according to claim 1, further comprising a static charge eliminator configured to neutralize static electric charges built up on the continuous web of material.

13. The self-contained web cleaning apparatus according to claim 12, wherein the static charge eliminator is located proximate to an input side of the self-contained web cleaning apparatus where the continuous web of material enters the self-contained web cleaning apparatus.

14. The self-contained web cleaning apparatus according to claim 1, further comprising:

a temperature sensor configured to detect a temperature of space in which the self-contained web cleaning apparatus is located, and to output a first signal indicative of the temperature;

a humidity sensor configured to detect a humidity of the space in which the self-contained web cleaning apparatus is located, and to output a second signal indicative of the humidity;

a visual display device disposed on a side of the self-contained web cleaning apparatus; and a control device operatively coupled to the temperature sensor, the humidity sensor, and the visual display device, the control device configured to process the first and second signals from temperature and humidity sensors to output the temperature and humidity information to the visual display device so that temperature and humidity information is visible to a user.

15. The self-contained web cleaning apparatus according to claim 14, wherein the visual display device is in the form of a touchscreen user interface.

16. The self-contained web cleaning apparatus according to claim 14, wherein the control device comprises a microprocessor.

17. The self-contained web cleaning apparatus according to claim 14, further comprising a throughput sensor operatively coupled to the control device, the throughput sensor configured to track the continuous web of material as the continuous web of material passes through the self-contained web cleaning apparatus, and the control device configured to determine a throughput count footage for the continuous web of material based upon output from the throughput sensor and to display the throughput: count footage on the visual display device.

18. The self-contained web cleaning apparatus according to claim 1, wherein the continuous web of material is in the form of a continuous web of paper being fed into a continuous feed inkjet printer.

19. The self-contained web cleaning apparatus according to claim 18, wherein the continuous web of paper is configured to pass through the self-contained web cleaning apparatus prior to the continuous web of paper entering the continuous feed inkjet printer so that the particulate matter is removed from the continuous web of paper prior to the continuous web of paper entering the continuous feed inkjet printer.

* * * * *